US012649966B2

(12) United States Patent
So et al.

(10) Patent No.: US 12,649,966 B2
(45) Date of Patent: Jun. 9, 2026

(54) STEEL MATERIAL HAVING LOW SURFACE HARDNESS AND EXCELLENT LOW TEMPERATURE IMPACT TOUGHNESS, AND METHOD FOR MANUFACTURING SAME

(71) Applicant: POSCO CO., LTD, Pohang-si (KR)

(72) Inventors: Tae-Il So, Gwangyang-Si (KR); Sang-Deok Kang, Gwangyang-Si (KR)

(73) Assignee: POSCO CO., LTD, Pohang-si (KR)

( * ) Notice: Subject to any disclaimer, the term of this patent is extended or adjusted under 35 U.S.C. 154(b) by 382 days.

(21) Appl. No.: 18/038,096

(22) PCT Filed: Nov. 17, 2021

(86) PCT No.: PCT/KR2021/016895
§ 371 (c)(1),
(2) Date: May 22, 2023

(87) PCT Pub. No.: WO2022/131581
PCT Pub. Date: Jun. 23, 2022

(65) Prior Publication Data

US 2023/0416890 A1 Dec. 28, 2023

(30) Foreign Application Priority Data

Dec. 15, 2020 (KR) ..... 10-2020-0175617

(51) Int. Cl.
*C22C 38/58* (2006.01)
*C21D 8/0221* (2026.01)
(Continued)

(52) U.S. Cl.
CPC ..... *C22C 38/58* (2013.01); *C21D 8/0226* (2013.01); *C21D 8/0263* (2013.01);
(Continued)

(58) Field of Classification Search
CPC ..... C22C 38/58; C22C 38/001; C22C 38/002; C22C 38/02; C22C 38/06; C22C 38/44;
(Continued)

(56) References Cited

U.S. PATENT DOCUMENTS

2005/0167013 A1 8/2005 Murao et al.
2013/0008570 A1 1/2013 Ikeda et al.
(Continued)

FOREIGN PATENT DOCUMENTS

EP 1 546 417 B1 6/2005
EP 3 561 123 A1 10/2019
(Continued)

OTHER PUBLICATIONS

Hara Takuya, et.al. [WO2015030210A1] (machine translation). (Year: 2015).*
(Continued)

*Primary Examiner* — Sally A Merkling
*Assistant Examiner* — Nazmun Nahar Shams
(74) *Attorney, Agent, or Firm* — Sughrue Mion, PLLC

(57) ABSTRACT

The present invention is to provide a steel material having low surface hardness and excellent low temperature impact toughness, and a method for manufacturing same.

10 Claims, 1 Drawing Sheet

(51) Int. Cl.

| | |
|---|---|
| ***C21D 8/0247*** | (2026.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/001* (2013.01); *C22C 38/002* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/005* (2013.01); *C21D 2211/008* (2013.01)

(58) Field of Classification Search
CPC ..... C22C 38/46; C22C 38/48; C22C 38/50; C22C 38/04; C21D 8/0226; C21D 8/0263; C21D 2211/002; C21D 2211/005; C21D 2211/008; C21D 1/18; C21D 1/26; C21D 9/50; C21D 9/46; C21D 8/0447
USPC ..... 420/119
See application file for complete search history.

(56) References Cited

U.S. PATENT DOCUMENTS

| | | | | |
|---|---|---|---|---|
| 2018/0105893 | A1 | 4/2018 | Ishitsuka et al. | |
| 2020/0263279 | A1 | 8/2020 | Um et al. | |
| 2021/0301365 | A1 | 9/2021 | So et al. | |
| 2021/0340653 | A1* | 11/2021 | Kawata | C21D 1/185 |

FOREIGN PATENT DOCUMENTS

| | | | | | |
|---|---|---|---|---|---|
| EP | 3 686 304 | A1 | | 7/2020 | |
| EP | 3 730 655 | A1 | | 10/2020 | |
| EP | 3 929 323 | A1 | | 12/2021 | |
| JP | 1-319629 | A | | 12/1989 | |
| JP | 2000-355728 | A | | 12/2000 | |
| JP | 2011-225975 | A | | 11/2011 | |
| JP | 6048621 | B1 | | 12/2016 | |
| JP | 6569842 | B1 | | 9/2019 | |
| KR | 101304859 | B1 | * | 9/2013 | |
| KR | 10-1735336 | B1 | | 5/2017 | |
| KR | 20170075936 | A | * | 7/2017 | C22C 38/58 |
| KR | 10-1778598 | B1 | | 9/2017 | |
| KR | 10-2031499 | B1 | | 10/2019 | |
| KR | 10-2020-0040826 | A | | 4/2020 | |
| KR | 10-2131538 | B1 | | 7/2020 | |
| WO | WO-2015030210 | A1 | * | 3/2015 | C22C 38/14 |
| WO | 2017/105107 | A1 | | 6/2017 | |
| WO | 2020/130436 | A2 | | 6/2020 | |

OTHER PUBLICATIONS

Hiroyuki Kawata, et.al. [JP6569842B1] (machine translation) (original provided in the IDS) (Year: 2019).*
Bai Jin Ho [KR20170075936A] (machine translation) (Year: 2017).*
Ahn Seong Soo, et.al. [KR101304859B1] (machine translation) (Year: 2013).*
International Search Report of PCT/KR2021/016895 dated Mar. 21, 2022 [PCT/ISA/210].
Extended European Search Report issued Jun. 26, 2025 in European Application No. 21906886.3.
Communication dated Mar. 17, 2026 in European Application No. 21 906 886.3.

* cited by examiner

STEEL MATERIAL HAVING LOW SURFACE HARDNESS AND EXCELLENT LOW TEMPERATURE IMPACT TOUGHNESS, AND METHOD FOR MANUFACTURING SAME

CROSS REFERENCE TO RELATED APPLICATIONS

This application is a National Stage of International Application No. PCT/KR2021/016895, filed Nov. 17, 2021, claiming priority to Korean Patent Application No. 10-2020-0175617, filed Dec. 15, 2020, the entire disclosures of which are incorporated herein by reference.

TECHNICAL FIELD

The present disclosure relates to a steel material having low surface hardness and excellent low temperature impact toughness, and a method for manufacturing the same.

BACKGROUND ART

Recently, demand for a steel material for pressure vessels used in industries such as mining, production, transportation, storage, refining, power generation, and the like, of energy resources, is gradually increasing, and as a usage environment becomes harsher, there is a trend that requirements, such as simultaneous guarantees of low hardness, ultra-thickness, low Ceq, long term PWHT, cryogenic impact toughness, and the like, are becoming more stringent.

In general, after manufacturing the steel material for pressure vessels in a form of a plate, it is common to bend the steel material in order to manufacture it in the form of a head or shell. However, when a hard phase such as martensite or low-temperature bainite exists on a surface of the material during bending, surface cracks may occur. In order to prevent such surface cracks, it is necessary to forma surface microstructure with a soft phase such as polygonal ferrite.

On the other hand, even if the microstructure can be obtained through slow cooling after rolling to improve bending workability, in order to obtain sufficient strength throughout the hot-rolled steel plate, it is essentially required to appropriately add alloying elements and perform water cooling, to introduce a low-temperature phase, for example, bainite or martensite. That is, when a soft phase such as polygonal ferrite and a hard phase such as bainite or martensite are simultaneously formed, it is difficult to obtain desired mechanical properties since it exhibits high surface hardness and low strength.

Therefore, it is necessary to find a method of forming the microstructure by being dualized into a soft phase and a hard phase, wherein a surface portion of the hot-rolled steel plate includes polygonal ferrite, a soft phase, and the remaining portion of the surface portion thereof, except for the surface portion, includes acicular ferrite, bainite, and martensite, hard phases.

Meanwhile, the steel material for pressure vessels has problems such as brittle fracture of the steel material in a cryogenic environment because impact toughness is lowered as a temperature of use of the steel material is lowered. Therefore, it is necessary to appropriately control the composition or microstructure of the steel material for pressure vessels applied to low-temperature regions, so that deterioration in impact toughness does not occur even at a low-temperature, as well as optimize rolling and heat treatment conditions. In general, in the case of a steel material for pressure vessels performing a quenching & tempering heat treatment, it is common to form a structure of acicular ferrite, tempered martensite, or tempered bainite due to a difference in cooling rate according to thickness, and in order to improve low-temperature impact toughness, it is necessary to refine a crystal grain or packet size of the structure as much as possible.

In general, as the method of refining the crystal grain or packet size of the structure, a method in which a reheating temperature and a hot rolling temperature of a steel slab are lowered as much as possible, and then a re-heat treatment temperature for quenching is also lowered as much as possible, to suppress grain growth of austenite, is mainly used.

According to Patent Document 1, a multi-stage cooling method was used to effectively obtain desired mechanical properties without an additional heat treatment in order to reduce surface hardness of a hot-rolled steel plate.

Specifically, a manufacturing method of performing water cooling at a high temperature and then cooling the hot-rolled steel plate at a low cooling rate using a cooling table and a slow cooling facility is described. However, it is considered that low-temperature impact toughness will be greatly deteriorated because not only a high content of carbon is used to satisfy the required mechanical properties, but also a separate tempering process is omitted, so it is difficult to simultaneously satisfy low hardness and low-temperature impact toughness, aimed at the present disclosure.

Prior Art Document (Patent Document 1) Korean Patent Publication No. 10-1735336 (published on May 15, 2017)

SUMMARY OF INVENTION

Technical Problem

An aspect of the present disclosure is to provide a steel material having low surface hardness and excellent low temperature impact toughness, and a method for manufacturing the same.

An object of the present disclosure is not limited to the above description. The object of the present disclosure will be understood from the entire content of the present specification, and a person skilled in the art to which the present disclosure pertains will understand an additional object of the present disclosure without difficulty.

Solution to Problem

According to an aspect of the present disclosure, a steel material includes, by weight: 0.08 to 0.14% of carbon (C), 0.1 to 0.5% of silicon (Si), 1.2 to 1.7% of manganese (Mn), 0.01% or less of phosphorus (P), 0.01% or less of sulfur (S), 0.01 to 0.05% of aluminum (Al), 0.05% or less of niobium (Nb), 0.01 to 0.5% of chromium (Cr), 0.01 to 0.25% of nickel (Ni), 0.01 to 0.1% of molybdenum (Mo), 0.01 to 0.05% of vanadium (V), 0.003% or less of titanium (Ti), 0.002 to 0.01% of nitrogen (N), with a balance of Fe and inevitable impurities, wherein, based on a thickness cross-section, the steel material includes a microstructure, wherein in the microstructure, a surface layer region, from a surface to 0.5 mm includes 90 area, or more of polygonal ferrite and a center region, the remaining region of the center region thereof, includes a mixed structure of 30 to 70 area % of acicular ferrite, and a remainder of tempered martensite and tempered bainite.

The surface layer region may include 10% or less of acicular ferrite and 5% or less of bainite as a microstructure.

The center region may include 40% or less of tempered bainite and 30% or less of tempered martensite, as a microstructure.

A thickness of the steel material may be 20 to 65 mm.

A maximum value of surface Vickers hardness of the steel material may be 225 Hv or less.

The steel material may have a yield strength of 415 MPa or more, a tensile strength of 550 MPa or more at a point of ¼t in the thickness direction, and an average impact toughness value of 150 J or more at −52° C.

According to another aspect of the present disclosure, a method for manufacturing a steel material, includes operations of: reheating a steel slab including, by weight: 0.08 to 0.14% of carbon (C), 0.1 to 0.5% of silicon (Si), 1.2 to 1.7% of manganese (Mn), 0.01% or less of phosphorus (P), 0.01% or less of sulfur (S), 0.01 to 0.05% of aluminum (Al), 0.05% or less of niobium (Nb), 0.01 to 0.5% of chromium (Cr), 0.01 to 0.25% of nickel (Ni), 0.01 to 0.1% of molybdenum (Mo), 0.01 to 0.05% of vanadium (V), 0.003% or less of titanium (Ti), 0.002 to 0.01% of nitrogen (N), with a balance of Fe and inevitable impurities;

rough rolling the reheated steel slab;

subjecting the rough-rolled steel to finish hot rolling at a temperature of Ar3+50° C. or higher;

air cooling the hot-rolled steel plate to room temperature;

performing a quenching operation of heating the air-cooled hot-rolled steel plate for 1.3t+30 minutes or more, where t refers to a thickness of steel in millimeters, in a temperature range of Ar3 or higher, then primary cooling the steel plate to a temperature of Ar3 or lower at a cooling rate of $(946\times t^{-1032})/60$ to 1.5° C./s, where t refers to a thickness of steel in millimeters, and secondary cooling the steel plate at a cooling rate of $11{,}500\times t^{-1788}$° C./s or more, where t refers to a thickness of steel in millimeters; and performing a tempering operation of heating the quenched steel plate for 1.9t+30 minutes or more, where t refers to a thickness of steel in millimeters, in a temperature range of 600 to 700° C., and then air cooling the same to room temperature.

The reheating operation is performed in a temperature range of 1100 to 1200° C., The rough rolling operation may be performed in a temperature range of Ac3+100 to 1200° C.

The primary cooling end temperature in the quenching operation may be 550° C. or higher.

The hot rolling operation may be performed so that the thickness of the steel material is 20 to 65 mm.

After the tempering operations, a PWHT heat treatment operation of heating in a temperature range of 550 to 650° C. for 1 hour or more per inch of the thickness may be further included.

Advantageous Effects of Invention

As set forth above, according to an aspect of the present disclosure, a steel material having low surface hardness and excellent low temperature impact toughness, and a method for manufacturing the same may be provided.

According to another aspect of the present disclosure, a steel material suitable for use in pressure vessels that can be used in a petrochemical manufacturing facility, a storage tank, and the like, and a method for manufacturing the same may be provided.

Best Mode for Invention

Figure 1A:
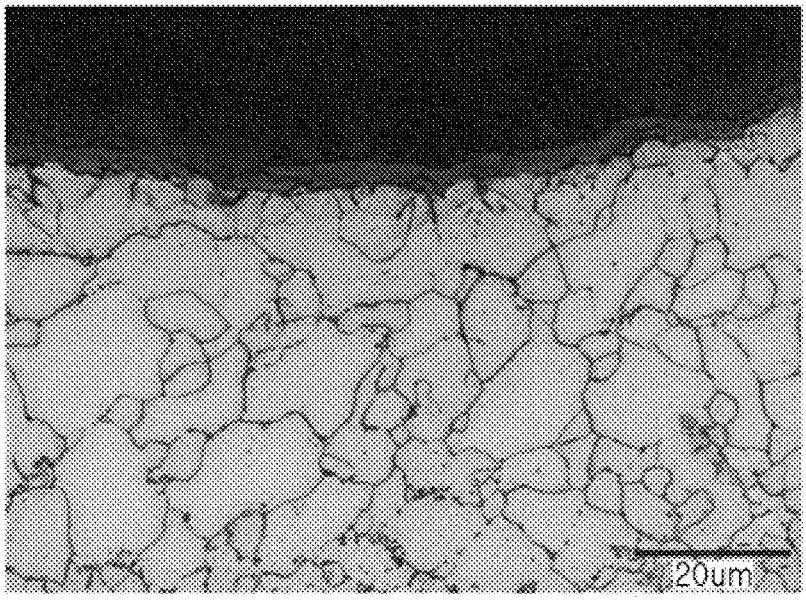
FIGS. 1(*a*) and 1(*b*) illustrates a surface microstructure and a microstructure at a ¼t point of Inventive Example 6, respectively.
Figure 1B:
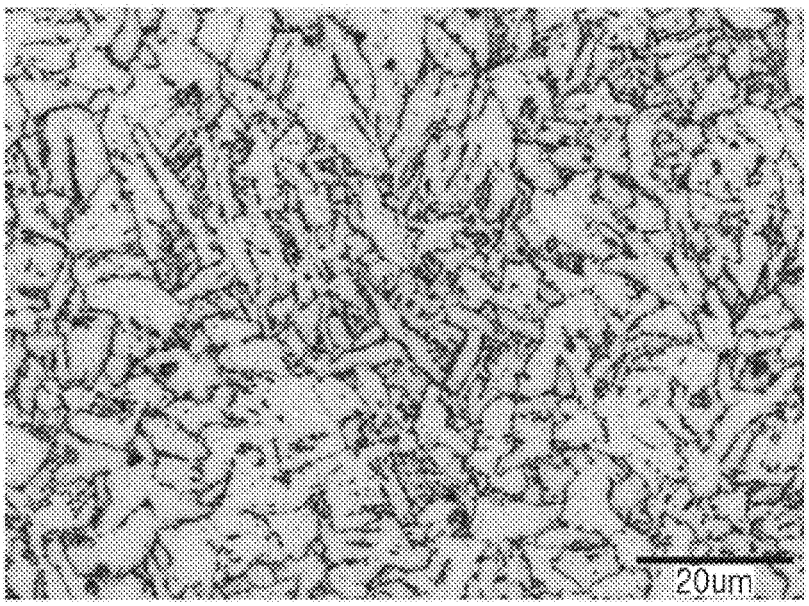

Hereinafter, preferred embodiments of the present disclosure will be described. Embodiments of the present disclosure may be modified in various forms, and the scope of the present disclosure should not be construed as being limited to the embodiments described below. The present embodiments are provided to those skilled in the art to further elaborate the present disclosure.

As processability of steel for pressure vessels is regarded as important and the use environment is expanded to extreme cold regions, the present inventors have recognized that it is necessary to develop a method capable of securing mechanical properties required for the material. In particular, the present inventors have studied in depth a method for securing low-temperature impact toughness with low surface hardness. As a result, it was confirmed that in alloy design, it is possible to provide a steel material for pressure vessels having target properties by controlling composition of components and a relationship between some components and at the same time optimizing cooling conditions during the manufacturing process, and thus the present disclosure was provided.

Hereinafter, the present disclosure will be described in more detail.

Hereinafter, a steel composition of the present disclosure will be described in more detail.

Hereinafter, represents a content of each element based on weight, unless otherwise particularly specified.

According to an aspect of the present disclosure, a steel material may include, by weight: 0.08 to 0.14% of carbon (C), 0.1 to 0.5% of silicon (Si), 1.2 to 1.7% of manganese (Mn), 0.01% or less of phosphorus (P), 0.01% or less of sulfur (S), 0.01 to 0.05% of aluminum (Al), 0.05% or less of niobium (Nb), 0.01 to 0.5% of chromium (Cr), 0.01 to 0.25% of nickel (Ni), 0.01 to 0.1% of molybdenum (Mo), 0.01 to 0.05% of vanadium (V), 0.003% or less of titanium (Ti), 0.002 to 0.01% of nitrogen (N), with a balance of Fe and inevitable impurities.

Carbon (C): 0.08 to 0.14%

Carbon (C) is an element which is effective for improving strength. In order to sufficiently obtain the above-described effect, 0.08% or more of carbon (C) may be included. However, when a content of C is more than 0.14%, a hard phase is formed on a surface thereof to increase hardness, and low-temperature impact toughness may be significantly impaired.

Accordingly, the content of carbon (C) may be 0.08 to 0.14%, a more preferable lower limit of the content of carbon (C) may be 0.09%, and a more preferable upper limit of content of carbon (C) may be 0.12%.

Silicon (Si): 0.1 to 0.5%

Silicon (Si) is an element, which is effective in deoxidation and is favorable to improve strength of steel. A content of silicon (Si) may be 0.1% or more. On the other hand, when the content of silicon (Si) is more than 0.5%, there is a concern that weldability and low-temperature toughness of steel may be inferior.

Accordingly, the content of silicon (Si) may be 0.1 to 0.5%, a more preferable lower limit of the content of silicon (Si) may be 0.2%, and a more preferable upper limit of content of silicon (Si) may be 0.4%.

Manganese (Mn): 1.2 to 1.7%

Manganese (Mn) is an element favorable to effectively improve the strength of steel through a solid solution strengthening effect. In order to sufficiently obtain the effect, it is preferable to include 1.2% or more of manganese (Mn). However, when a content of manganese (Mn) is more than 1.7%, there is a problem in which a hard phase is formed on a surface thereof so that hardness is excessively increased, and there is a problem in which manganese (Mn) is bonded to S in steel to form MnS, so that a room-temperature elongation and low-temperature toughness are greatly impaired.

Accordingly, the content of manganese (Mn) may be 1.2 to 1.7%, a more preferable lower limit of the content of manganese (Mn) may be 1.4%, and a more preferable upper limit of the content of manganese (Mn) may be 1.6%.

Phosphorous (P): 0.01% or Less

Phosphorus (P) is an element which is favorable to improve strength and secure corrosion resistance of steel, but since it can greatly deteriorate impact toughness of steel. Thus, it is preferred to limit a content of P to be as low as possible. Even when phosphorus (P) is contained at 0.01% or less, there is no problem in securing the target mechanical properties in the present disclosure, so an upper limit of the content of phosphorus (P) may be limited to 0.01%. However, 0% may be excluded considering an inevitably contained level.

Accordingly, the content of phosphorus (P) may be 0.01% or less.

Sulfur (S): 0.01% or Less

Sulfur (S) is an element which is bonded to Mn in steel to form MnS, or the like, to greatly deteriorate impact toughness of steel. Thus, it is preferred to limit a content of P to be as low as possible. Even when sulfur (S) is contained at 0.01% or less, there is no problem in securing the target mechanical properties in the present disclosure, so an upper limit of the content of sulfur (S) can be limited to 0.01%. However, 0% may be excluded considering an inevitably contained level.

Accordingly, the content of sulfur (S) may be 0.01% or less.

Aluminum (Al): 0.01 to 0.05%

Aluminum (Al) is an element capable of deoxidizing molten steel at low cost, and in order to sufficiently obtain this effect, it is preferable to include aluminum (Al) in an amount of 0.01% or more. However, when a content of aluminum (Al) is more than 0.05%, it may cause nozzle clogging during continuous casting.

Accordingly, a content of aluminum (Al) may be 0.01 to 0.05%, a more preferable lower limit of the content of aluminum (Al) may be 0.02%, and a more preferable upper limit of the content of aluminum (Al) may be 0.04%.

Niobium (Nb): 0.05% or Less

Niobium (Nb) precipitates in a form of NbC or Nb (C,N) to greatly improve strength of a base material, and when reheated to a high temperature, dissolved niobium (Nb) may suppress recrystallization of austenite and transformation of ferrite or bainite, so that a structure refining effect can be obtained. However, niobium (Nb) is not only expensive, but when excessively added, it forms coarse (Ti,Nb) CN with Ti during heating or after PWHT, which becomes a factor that deteriorates low-temperature impact toughness. Therefore, an upper limit of a content of niobium (Nb) may be limited to 0.05%. However, 0% may be excluded considering an inevitably contained level.

Accordingly, the content of niobium (Nb) may be 0.05% or less, a more preferable the content of niobium (Nb) may be 0.03% or less.

Chromium (Cr): 0.01 to 0.5%

Chromium (Cr) is an element effective in increasing hardenability to form bainite, which is a low-temperature phase, and securing strength, and it is preferable to include 0.01% or more of chromium (Cr) in order to sufficiently obtain these effects. However, excessive addition of chromium (Cr) may cause the formation of martensite and an increase in a fraction thereof, thereby greatly reducing low-temperature impact toughness, so an upper limit of a content of chromium (Cr) may be limited to 0.5%.

Accordingly, the content of chromium (Cr) may be 0.01 to 0.5%, more preferably 0.2% or less.

Nickel (Ni): 0.01 to 0.25%

Nickel (Ni) is an element for simultaneously improving strength and low-impact toughness. In order to obtain the effect described above, it is preferable that 0.01% or more of nickel (Ni) may be added. However, nickel (Ni) is an element increasing hardenability and may be a factor in increasing surface hardness, and is an expensive element, and when a content of nickel (Ni) is more than 0.25%, there is a problem in that economic efficiency is greatly reduced.

Accordingly, the content of nickel (Ni) may be 0.01 to 0.25%, and more preferably, the content of nickel (Ni) may be 0.15% or less.

Molybdenum (Mo): 0.01 to 0.1%

Molybdenum (Mo) greatly improves hardenability even with a small addition amount thereof and is favorable to greatly improve strength. In order to sufficiently obtain these effects, it is preferable that 0.01% or more of molybdenum (Mo) is added. However, molybdenum (Mo) is an expensive element, and when excessively added, it may cause an excessive increase in surface hardness and deteriorate low-temperature impact toughness, so an upper limit of a content of molybdenum (Mo) may be limited to 0.1%.

Accordingly, the content of molybdenum (Mo) may be 0.01 to 0.1%, a more preferable lower limit of the content of molybdenum (Mo) may be 0.04%, and a more preferable upper limit of content of molybdenum (Mo) may be 0.08%.

Vanadium (V): 0.01 to 0.05%

Vanadium (V) has a low melting temperature, compared to other alloy elements, and has an effect of preventing a decrease in strength by being precipitated in a welding heat-affected zone during welding. When strength is not sufficiently secured after a heat treatment after welding (PWHT), a strength improvement effect may be obtained by adding 0.01% or more of vanadium (V). However, when a content of vanadium (V) is more than 0.05%, not only a fraction of hard phases such as Martensite & Austenite (MA) increases, but also there is a problem in that low-temperature impact toughness is deteriorated due to coarse VC precipitation during a long-term PWHT heat treatment.

Accordingly, the content of vanadium (V) may be 0.01 to 0.05%, a more preferable lower limit of the content of vanadium (V) may be 0.015%, and a more preferable upper limit of the content of vanadium (V) may be 0.035%.

Titanium (Ti): 0.003% or Less

Titanium (Ti), when added together with N, forms TiN, which serves to reduce occurrence of surface cracks due to formation of AlN precipitates. However, when a content of titanium (Ti) is more than 0.003%, coarse TiN is formed during reheating, quenching & tempering, and PWHT heat treatment of the steel slab, which may act as a factor deteriorating low-temperature impact toughness.

Accordingly, the content of titanium (Ti) may be 0.003% or less.

Nitrogen (N): 0.002 to 0.01%

Nitrogen (N), when added together with Ti, forms TiN, and is an element favorable to suppress crystal grain growth due to thermal effects during welding. When adding Ti, it is preferable that nitrogen (N) is added in an amount of 0.002% or more. However, when a content of nitrogen (N) is more than 0.01%, coarse TiN is formed and low-temperature impact toughness is deteriorated, which is not preferable.

Accordingly, the content of nitrogen (N) may be 0.002 to 0.01%.

The steel material of the present disclosure may include a remainder of Fe and other inevitable impurities in addition to the components described above. However, since in the common manufacturing process, unintended impurities may be inevitably incorporated from raw materials or the surrounding environment, the component may not be excluded. Since these impurities are known to any person skilled in the common steelmaking manufacturing process, the entire contents thereof are not particularly mentioned in the present specification.

Hereinafter, a microstructure of steel of the present disclosure will be described in detail.

In the present disclosure, s representing the fraction of the microstructure is based on the area unless otherwise specified.

According to an aspect of the present disclosure, the steel material may have, based on a thickness cross-section, a microstructure comprising a surface layer region from a surface to 0.5 mm includes 90% or more of polygonal ferrite, a center region, the remaining region thereof includes a mixed region of 30 to 70% of acicular ferrite, and a remainder of tempered martensite and tempered bainite.

When polygonal ferrite is less than 90 in the surface layer region to 0.5 mm from a surface thereof, the desired low hardness characteristics cannot be secured. As the microstructure of the surface layer region, other structures excluding polygonal ferrite may include acicular ferrite and bainite. More preferably, in the present disclosure, other structures of the surface layer region may include 10% or less of acicular ferrite and 5% or less of bainite.

In the center region, a region other than the surface layer region, there is a problem in that strength is lowered when acicular ferrite exceeds 70%, and when a fraction thereof is less than 30%, a hard phase increases so that there is a problem in that it is difficult to secure low-temperature impact toughness. Tempered bainite and tempered martensite may be included in an amount of 30 to 70% in the center region, and more preferably, tempered bainite may be included in an amount of 40, or less and tempered martensite may be included in an amount of 30% or less.

Hereinafter, a method for manufacturing steel of the present disclosure will be described in detail.

A steel plate according to an aspect of the present disclosure may be manufactured by reheating, hot rolling, quenching, and tempering a steel slab satisfying the alloy composition described above.

Slab Reheating

A steel slab satisfying the alloy composition described above may be reheated in a temperature range of 1100 to 1200° C.

Prior to performing hot rolling to be described later, it is preferable to perform a process of heating and homogenizing the steel slab. When the heating temperature of the steel slab is lower than 1100° C., precipitates (carbides) formed in the slab are not sufficiently re-dissolved, and thus the formation of precipitates is reduced in a process after hot rolling. On the other hand, when the temperature is higher than 1200° C., there is a concern that austenite crystal grains become coarse and deteriorate mechanical properties of the steel.

Hot Rolling

The reheated steel slab may be rough rolled in a temperature range of Ac3+1000 to 1200° C., and the rough-rolled steel may be finish hot rolled at a temperature of Ac3+50° C. or higher.

When the rough rolling temperature is lower than Ac3+100° C., there is a problem in that a temperature is lowered during subsequent finish hot rolling.

When the finish hot rolling temperature is lower than Ac3+50° C., a rolling load is increased so that it is difficult to secure a shape of the hot-rolled steel plate and there is a concern that quality defects such as surface cracks, or the like may occur.

The hot-rolled steel plate may be air-cooled to room temperature.

$$Ac3=937.2-436.5[C]+56[Si]-19.7[Mn]-26.6[Ni]+38.1[Mo]+124.8[V]+136.3[Ti]-19.1[Nb]+198.4[Al]$$

where, [C], [Si], [Mn], [Ni], [Mo], [V], [Ti], [Nb], and [Al] refer to contents (weight %) of each element.

Quenching

After heating the air-cooled hot-rolled steel plate for 1.3t+30 minutes or more, where t refers to a thickness of steel in millimeters in a temperature range of Ac3 or higher, the hot-rolled steel plate may be primarily cooled to a temperature of Ar3 or lower at a cooling rate of $(946\times t^{-1.032})/60$ to 1.5° C./s, where t refers to a thickness of steel in millimeters, and secondarily cooled at a cooling rate of $11{,}500\times t^{-1.788}$° C./s, where t refers to a thickness of steel in millimeters.

The air-cooled hot-rolled steel plate may be reheated to form an austenite structure, but when the reheating temperature is lower than Ac3, a structure of the hot-rolled steel plate becomes a two-phase structure of ferrite and austenite, which may significantly deteriorate mechanical properties. In the present disclosure, the temperature may be more preferably 870 to 930° C.

In addition, it is preferable to hold for 1.3t+30 minutes or more so that a 100% of austenite phase can be formed.

After maintaining at a heating temperature, as the primary cooling, either air cooling or water cooling may be selected depending on the thickness of the hot-rolled steel plate. When the primary cooling rate is lower than $(946\times t^{-1.032})/60$° C./s, crystal grains of polygonal ferrite may be coarsened, and when the rate exceeds 1.5° C./s, bainite may be excessively introduced, so that there may be a concern that hardness may increase.

When a primary cooling end temperature is higher than Ar3, polygonal ferrite in a surface portion may not be sufficiently formed. More preferably, the cooling may be terminated in a temperature range of a bainite transformation start temperature or higher, in a temperature of 550° C. or higher, and more preferably, the cooling may be performed at a cooling end temperature of 650° C. or higher.

When the secondary cooling rate is less than $11{,}500\times t^{-1788}$° C./s, strength and low-temperature impact toughness may be deteriorated due to the formation of coarse bainite.

The secondary cooling is preferably performed by water cooling. In the case of secondary cooling, it can be cooled to room temperature.

The multi-stage cooling rate may be controlled by controlling a flow rate for each cooling bank and a plate-threading speed of the hot-rolled steel plate.

$$Ar3=910-310[C]-80[Mn]-20[Cu]-55[Ni]-80[Mo]+119[V]+124[Ti]-18[Nb]+179[Al]$$

where, [C], [Si], [Mn], [Ni], [Mo], [V], [Ti], [Nb], and [Al] refer to contents (weight %) of each element.

Tempering

The quenched hot-rolled steel plate may be heated in a temperature range of 600 to 700° C. for 1.9t+30 minutes or more, where t refers to a thickness of steel in millimeters, and then air-cooled to room temperature.

When a heating temperature of the cooled hot-rolled steel plate is lower than 600° C., it is difficult to form fine precipitates during a heat treatment, and when the heating temperature thereof is higher than 700° C., low-temperature impact toughness may be significantly deteriorated due to the formation of coarse precipitates.

PWHT Heat Treatment

In general, since a steel material for pressure vessels is used after being welded, a PWHT heat treatment can be performed to overcome toughness deterioration of a welded portion.

In the present disclosure, as needed, it is preferable to stabilize the toughness of the steel material after welding the same by subjecting the air-cooled hot-rolled steel plate to a post-weld heat treatment in which the air-cooled hot-rolled steel plate is heated for 1 hour or more per inch of the thickness of the steel plate in a temperature range of 550 to 650° C.

During the PWHT heat treatment, when the temperature is lower than 550° C., an elongated heat treatment is required, resulting in a problem of poor economic efficiency. On the other hand, when the temperature is higher than 650° C., a strength reduction effect is excessively increased, and carbides are coarsened, so that there is a concern that the impact toughness may also be reduced.

The steel material of the present disclosure manufactured as described above may have a thickness of 20 to 65 mm, a maximum value of Vickers hardness of 225 Hv or less on the surface, a yield strength of 415 MPa or more evaluated perpendicular to a rolling direction at a ¼ t point thereof, a tensile strength of 550 MPa or more, and an average value of Charpy impact absorption energy (CVN) of 150 J or more at −52° C., exhibiting excellent strength and low-temperature impact toughness characteristics.

Hereinafter, the present disclosure will be specifically described through the following Examples. However, it should be noted that the following examples are only for describing the present disclosure in detail by illustration, and are not intended to limit the scope of rights of the present disclosure.

MODE FOR INVENTION

Molten steel having the alloy compositions shown in Table 1 was continuously casted to prepare a casting slab. In this case, the casting slab was manufactured to have a thickness of 300 mm. After heating the slab to 1120° C., rough rolling the slab in a temperature range of 1000 to 1050° C., and then hot rolling the same at a finish hot rolling temperature shown in Table 2 below to, prepare a hot-rolled steel plate having a thickness of 25 mm and 50 mm. For steel types A to I, X-a for steel having a thickness of 25 mm and X-b for steel having a thickness were shown in Table 2.

After the hot-rolled steel plate was air cooled to room temperature, it was quenched under the quenching conditions of Table 2, and then tempering was performed. In the present disclosure, when a thickness of the steel plate is 25 mm, a primary cooling rate is preferably 0.57 to 1.5° C./s, and a secondary cooling rate is preferably 36.4° C./s or more. In addition, when the thickness of the steel plate is 50 mm, the primary cooling rate is preferably 0.28 to 1.5° C./s, and the secondary cooling rate is preferably 10.5° C./s or more.

TABLE 1

| STEEL | ALLOY COMPOSITION (WEIGHT %) | | | | | | | | | | | | |
|---|---|---|---|---|---|---|---|---|---|---|---|---|---|
| TYPE | C | Si | Mn | P | S | Al | Nb | Cr | Ni | Mo | V | Ti | N |
| A | 0.102 | 0.350 | 1.560 | 0.008 | 0.001 | 0.030 | 0.015 | 0.100 | 0.100 | 0.070 | 0.025 | 0.001 | 0.0035 |
| B | 0.097 | 0.340 | 1.450 | 0.008 | 0.001 | 0.025 | 0.012 | 0.090 | 0.140 | 0.065 | 0.025 | 0.002 | 0.0035 |
| C | 0.125 | 0.350 | 1.550 | 0.008 | 0.001 | 0.027 | 0.010 | 0.050 | 0.100 | 0.070 | 0.024 | 0.001 | 0.0035 |
| D | 0.105 | 0.320 | 1.650 | 0.009 | 0.001 | 0.028 | 0.014 | 0.180 | 0.220 | 0.050 | 0.022 | 0.001 | 0.0034 |
| E | 0.117 | 0.240 | 1.370 | 0.008 | 0.001 | 0.025 | 0.010 | 0.220 | 0.050 | 0.070 | 0.030 | 0.002 | 0.0030 |
| F | 0.105 | 0.340 | 1.550 | 0.008 | 0.001 | 0.027 | 0.014 | 0.100 | 0.110 | 0.070 | 0.025 | 0.001 | 0.0035 |
| G | 0.165 | 0.340 | 1.440 | 0.008 | 0.001 | 0.026 | 0.011 | 0.095 | 0.130 | 0.130 | 0.025 | 0.002 | 0.0033 |
| H | 0.055 | 0.350 | 1.550 | 0.008 | 0.001 | 0.027 | 0.010 | 0.100 | 0.100 | 0.050 | 0.024 | 0.001 | 0.0035 |
| I | 0.180 | 0.320 | 1.860 | 0.009 | 0.001 | 0.029 | 0.015 | 0.100 | 0.220 | 0.060 | 0.025 | 0.001 | 0.0034 |

TABLE 2

| | HOT ROLLING | QUENCHING | | | | | TEMPERING | |
|---|---|---|---|---|---|---|---|---|
| | FINISH | | | PRI- | PRIMARY | SEC- | | |
| STEEL TYPE | HOT ROLLING TEMPER-ATURE (° C.) | HEATING TEMPER-ATURE (° C.) | HOLDING TIME (MIN.) | MARY COOLING RATE (° C./s) | COOLING END TEMPERATURE (° C.) | ONDARY COOLING RATE (° C./s) | TEMPER-ATURE HEATING (° C.) | HOLDING TIME (MIN.) |
| A-a | 962 | 910 | 68 | 0.6 | 746 | 42 | 641 | 78 |
| B-a | 960 | 908 | 68 | 0.6 | 754 | 42 | 640 | 78 |
| C-a | 965 | 908 | 68 | 0.6 | 739 | 42 | 641 | 78 |

TABLE 2-continued

| STEEL TYPE | HOT ROLLING FINISH HOT ROLLING TEMPERATURE (° C.) | QUENCHING HEATING TEMPERATURE (° C.) | HOLDING TIME (MIN.) | PRIMARY COOLING RATE (° C./s) | PRIMARY COOLING END TEMPERATURE (° C.) | SECONDARY COOLING RATE (° C./s) | TEMPERING TEMPERATURE HEATING (° C.) | HOLDING TIME (MIN.) |
|---|---|---|---|---|---|---|---|---|
| D-a | 958 | 911 | 68 | 0.6 | 731 | 42 | 638 | 78 |
| E-a | 964 | 910 | 68 | 0.6 | 759 | 42 | 642 | 78 |
| F-a | 967 | 910 | 68 | 42 | 745 | 42 | 640 | 78 |
| G-a | 962 | 911 | 68 | 0.6 | 734 | 34 | 638 | 78 |
| H-a | 959 | 910 | 68 | 0.6 | 761 | 42 | 639 | 78 |
| I-a | 960 | 908 | 68 | 5.4 | 691 | 42 | 640 | 78 |
| A-b | 970 | 910 | 115 | 0.3 | 746 | 12 | 640 | 125 |
| B-b | 969 | 908 | 115 | 0.3 | 754 | 12 | 639 | 125 |
| C-b | 974 | 909 | 115 | 0.3 | 739 | 12 | 611 | 125 |
| D-b | 967 | 911 | 115 | 0.3 | 731 | 12 | 640 | 125 |
| E-b | 970 | 909 | 115 | 0.3 | 759 | 12 | 641 | 125 |
| F-b | 975 | 909 | 115 | 12 | 745 | 12 | 639 | 125 |
| G-b | 971 | 910 | 115 | 0.3 | 734 | 8.5 | 640 | 125 |
| H-b | 968 | 911 | 115 | 0.3 | 761 | 12 | 638 | 125 |
| I-b | 968 | 910 | 115 | 3.5 | 691 | 12 | 642 | 125 |

$$Ac3=937.2-436.5[C]+56[Si]-19.7[Mn]-26.6[Ni]+38.1[Mo]+124.8[V]+136.3[Ti]-19.1[Nb]+198.4[Al]$$

where, [C], [Si], [Mn], [Ni], [Mo], [V], [Ti], [Nb], and [Al] refer to contents (weight %) of each element.

$$Ar3=910-310[C]-80[Mn]-20[Cu]-55[Ni]-80\ [Mo]+119\ [V]+124\ [Ti]-18\ [Nb]+179\ [Al]$$

where, [C], [Mn], [Cu], [Ni], [Mo], [V], [Ti], [Nb], and [Al] refer to contents (weight %) of each element.

Thereafter, a microstructure of a surface layer region and a center region of each of the steel materials manufactured above was observed, and in this case, in the surface layer region, the microstructure of a surface of the steel material was observed, and in the center region, the microstructure at a ¼ t point in the thickness direction was observed. The microstructure of the steel material was observed with an optical microscope, and then a fraction of each phase was measured using an analysis program, and the results thereof were shown in Table 3 below.

In addition, mechanical properties of each steel material manufactured above were evaluated and are illustrated in Table 3. After measuring hardness at least 5 times using a Vickers hardness tester on the upper surface of the steel material, a maximum value thereof was shown, and the mechanical properties were evaluated using a specimen at the ¼t point in the thickness direction. In this case, for a tensile specimen, a JIS No. 1 standard test specimen was taken from each point in the thickness direction in a direction perpendicular to a rolling direction, and tensile strength (TS), yield strength (YS), and elongation (El) were measured. In addition, for an impact specimen, a JIS No. 4 standard test specimen was taken from a ¼t point in the thickness direction in a direction perpendicular to a rolling direction, and average impact toughness (CVN) at −52° C. was measured and the results thereof were shown.

TABLE 3

| STEEL TYPE | MICROSTRUCTURE (AREA %) SURFACE LAYER REGION PF | AF | B | CENTRAL REGION AF | TB | TM | MECHANICAL PROPERTIES SURFACE HARDNESS (Hv) | YIELD STRENGTH (MPa) | TENSILE STRENGTH (MPa) | ELONGATION (%) | IMPACT TOUGHNESS (−52° C., J) | DIVISION |
|---|---|---|---|---|---|---|---|---|---|---|---|---|
| A-a | 95 | 5 | 0 | 60 | 30 | 10 | 216 | 475 | 584 | 53 | 302 | INVENTIVE EXAMPLE1 |
| B-a | 95 | 5 | 0 | 60 | 35 | 5 | 211 | 444 | 576 | 51 | 296 | INVENTIVE EXAMPLE2 |
| C-a | 100 | 0 | 0 | 55 | 35 | 10 | 205 | 465 | 591 | 52 | 285 | INVENTIVE EXAMPLE3 |
| D-a | 95 | 5 | 0 | 65 | 30 | 5 | 212 | 464 | 580 | 53 | 301 | INVENTIVE EXAMPLE4 |
| E-a | 95 | 5 | 0 | 55 | 30 | 15 | 212 | 474 | 592 | 51 | 276 | INVENTIVE EXAMPLE5 |
| F-a | 65 | 20 | 15 | 65 | 35 | 0 | 239 | 459 | 572 | 58 | 280 | COMPARATIVE EXAMPLE1 |
| G-a | 65 | 25 | 10 | 75 | 25 | 0 | 222 | 451 | 545 | 54 | 67 | COMPARATIVE EXAMPLE2 |
| H-a | 100 | 0 | 0 | 95 | 5 | 0 | 186 | 396 | 531 | 51 | 386 | COMPARATIVE EXAMPLE3 |
| I-a | 25 | 65 | 10 | 0 | 45 | 55 | 261 | 502 | 635 | 31 | 42 | COMPARATIVE EXAMPLE4 |

TABLE 3-continued

| STEEL | MICROSTRUCTURE (AREA %) SURFACE LAYER REGION | | | CENTRAL REGION | | | MECHANICAL PROPERTIES SURFACE HARDNESS | YIELD STRENGTH | TENSILE STRENGTH | ELONGATION | IMPACT TOUGHNESS | |
|---|---|---|---|---|---|---|---|---|---|---|---|---|
| TYPE | PF | AF | B | AF | TB | TM | (Hv) | (MPa) | (MPa) | (%) | (−52° C., J) | DIVISION |
| A-b | 95 | 5 | 0 | 65 | 35 | 0 | 212 | 457 | 574 | 55 | 276 | INVENTIVE EXAMPLE6 |
| B-b | 95 | 5 | 0 | 65 | 35 | 0 | 205 | 435 | 567 | 54 | 285 | INVENTIVE EXAMPLE7 |
| C-b | 100 | 0 | 0 | 55 | 35 | 10 | 214 | 455 | 580 | 56 | 264 | INVENTIVE EXAMPLE8 |
| D-b | 95 | 5 | 0 | 55 | 35 | 10 | 210 | 448 | 570 | 55 | 296 | INVENTIVE EXAMPLE9 |
| E-b | 100 | 0 | 0 | 55 | 30 | 15 | 220 | 463 | 582 | 54 | 256 | INVENTIVE EXAMPLE10 |
| F-b | 65 | 20 | 15 | 65 | 35 | 0 | 235 | 459 | 572 | 61 | 270 | COMPARATIVE EXAMPLE5 |
| G-b | 70 | 20 | 10 | 70 | 30 | 0 | 212 | 431 | 544 | 39 | 78 | COMPARATIVE EXAMPLE6 |
| H-b | 100 | 0 | 0 | 100 | 0 | 0 | 175 | 390 | 527 | 56 | 385 | COMPARATIVE EXAMPLE7 |
| I-b | 25 | 65 | 10 | 0 | 45 | 55 | 252 | 497 | 622 | 35 | 34 | COMPARATIVE EXAMPLE8 |

PF: POLYGONAL FERRITE,
AF: ACICULAR FERRITE,
B: BAINITE,
TB: TEMPERED BAINITE,
TM: TEMPERED MARTENSITE

As shown in Table 3, it can be confirmed that Inventive Examples satisfying the alloy composition and manufacturing conditions proposed in the present disclosure satisfied all mechanical properties targeted in the present disclosure.

Meanwhile, in Comparative Examples 1 and 5 satisfying the component range proposed in the present disclosure but multi-stage cooling was not applied during quenching, it can be seen that surface harness was measured high due to a high fraction of a hard phase in the surface layer region, which was outside of the hardness value suggested in the present disclosure.

In Comparative Examples 2 and 6 in which the secondary cooling rate was lower than the range proposed in the present disclosure, and it can be confirmed that the tensile strength did not fall within the range of the present disclosure.

In Comparative Examples 3 and 7 in which the C content did not fall within the range proposed in the present disclosure, and the surface hardness had a sufficiently low value, but it could be seen that the tensile strength did not reach a value targeted in the present disclosure.

In Comparative Examples 4 and 8 in which the content of C and Mn exceeded the values proposed in the present disclosure, and the primary cooling rate during quenching also exceeded the range of the present disclosure, it can be confirmed not only the surface hardness exceeded the range of the present disclosure, but also the impact toughness value was not satisfied.

While example embodiments have been shown and described above, it will be apparent to those skilled in the art that modifications and variations could be made without departing from the scope of the present disclosure as defined by the appended claims.

The invention claimed is:

1. A steel material comprising, by weight:

0.08 to 0.14% of carbon (C), 0.1 to 0.5% of silicon (Si), 1.2 to 1.7% of manganese (Mn), 0.01% or less of phosphorus (P), 0.01% or less of sulfur(S), 0.01 to 0.05% of aluminum (Al), 0.05% or less of niobium (Nb), 0.01 to 0.5% of chromium (Cr), 0.01 to 0.25% of nickel (Ni), 0.01 to 0.1% of molybdenum (Mo), 0.01 to 0.05% of vanadium (V), 0.003% or less of titanium (Ti), 0.002 to 0.01% of nitrogen (N), with a balance of Fe and inevitable impurities, wherein, based on a thickness cross-section, the steel material includes a microstructure, wherein in the microstructure, a surface layer region, from a surface to 0.5 mm consists of 90 area % or more of polygonal ferrite, 10 area % or less of acicular ferrite and 5 area % or less of bainite; and a center region other than the surface layer region includes a mixed structure of 30 to 70 area % of acicular ferrite, and a remainder of tempered martensite and tempered bainite.

2. The steel material of claim 1, wherein the center region comprises 40 area % or less of tempered bainite and 30 area % or less of tempered martensite as a microstructure.

3. The steel material of claim 1, wherein the steel material has a thickness of 20 to 65 mm.

4. The steel material of claim 1, wherein the steel material has a maximum value of surface Vickers hardness of 225 Hv or less.

5. The steel material of claim 1, wherein the steel material has a yield strength of 415 MPa or more and a tensile strength of 550 MPa or more at a ¼ point in the thickness direction, and an average impact toughness value of 150 J or more at −52° C.

6. A method for manufacturing the steel material of claim 1, comprising operations of:

reheating a steel slab including, by weight: 0.08 to 0.14% of carbon (C), 0.1 to 0.5% of silicon (Si), 1.2 to 1.7% of manganese (Mn), 0.01% or less of phosphorus (P), 0.01% or less of sulfur(S), 0.01 to 0.05% of aluminum (Al), 0.05% or less of niobium (Nb), 0.01 to 0.5% of chromium (Cr), 0.01 to 0.25% of nickel (Ni), 0.01 to 0.1% of molybdenum (Mo), 0.01 to 0.05% of vanadium (V), 0.003% or less of titanium (Ti), 0.002 to 0.01% of nitrogen (N), with a balance of Fe and inevitable impurities;

rough rolling the reheated steel slab;

subjecting the rough-rolled steel to finish hot rolling at a temperature of Ar3+50° C. or higher;

air cooling the hot-rolled steel plate to room temperature;

performing a quenching operation of heating the air-cooled hot-rolled steel plate for 1.3t+30 minutes or more, where t refers to a thickness of steel in millimeters, in a temperature range of Ar3 or higher, then primary cooling the steel plate to a temperature of Ar3 or lower at a cooling rate of $(946\times t^{-1.032})/60$ to 1.5° C./s, where t refers to a thickness of steel in millimeters, and secondary cooling the steel plate at a cooling rate of $11{,}500\times t^{-1.788}$° C./s or more, where t refers to a thickness of steel in millimeters; and performing a tempering operation of heating the quenched steel plate for 1.9t+30 minutes or more, where t refers to a thickness of steel in millimeters, in a temperature range of 600 to 700° C., and then air cooling the same to room temperature.

7. The method for manufacturing a steel material of claim 6, wherein the reheating operation is performed in a temperature range of 1100 to 1200° C., and the rough rolling operation is performed in a temperature range of Ac3+100 to 1200° C.

8. The method for manufacturing a steel material of claim 6, wherein a primary cooling end temperature in the quenching operation is 550° C. or higher.

9. The method for manufacturing a steel material of claim 6, wherein the hot rolling operation is performed so that a thickness of the steel material is 20 to 65 mm.

10. The method for manufacturing a steel material of claim 6, further comprising:

a PWHT heat-treatment operation of heating the steel material for 1 hour or more per inch of the thickness in a temperature range of 550 to 650° C. after the tempering operation.

* * * * *